US010519007B2

(12) United States Patent
Kikuchi

(10) Patent No.: US 10,519,007 B2
(45) Date of Patent: Dec. 31, 2019

(54) PASSENGER CONVEYOR

(71) Applicant: TOSHIBA ELEVATOR KABUSHIKI KAISHA, Kawasaki-shi, Kanagawa (JP)

(72) Inventor: Takayuki Kikuchi, Kawasaki (JP)

(73) Assignee: TOSHIBA ELEVATOR KABUSHIKI KAISHA, Kawasaki-Shi (JP)

( * ) Notice: Subject to any disclaimer, the term of this patent is extended or adjusted under 35 U.S.C. 154(b) by 0 days.

(21) Appl. No.: 16/222,692

(22) Filed: Dec. 17, 2018

(65) Prior Publication Data

US 2019/0270616 A1 Sep. 5, 2019

(30) Foreign Application Priority Data

Mar. 1, 2018 (JP) ..... 2018-036177

(51) Int. Cl.

| | |
|---|---|
| ***B66B 25/00*** | (2006.01) |
| ***B66B 21/00*** | (2006.01) |
| ***B66B 21/02*** | (2006.01) |
| ***B66B 23/22*** | (2006.01) |
| ***B66B 23/24*** | (2006.01) |
| ***B66B 27/00*** | (2006.01) |

(52) U.S. Cl.

CPC ..... *B66B 25/006* (2013.01); *B66B 21/025* (2013.01); *B66B 23/225* (2013.01); *B66B 23/24* (2013.01); *B66B 25/00* (2013.01); *B66B 27/00* (2013.01)

(58) Field of Classification Search

None

See application file for complete search history.

(56) References Cited

U.S. PATENT DOCUMENTS

| | | | | |
|---|---|---|---|---|
| 5,782,330 | A * | 7/1998 | Mehlert | B66B 27/00 198/322 |
| 8,077,050 | B2 * | 12/2011 | Smith | G06Q 50/30 340/5.1 |
| 10,214,391 | B2 * | 2/2019 | Wang | B66B 21/02 |
| 2016/0368741 | A1 | 12/2016 | Blondiau et al. | |
| 2018/0029841 | A1 * | 2/2018 | Li | B66B 29/06 |

FOREIGN PATENT DOCUMENTS

| | | | |
|---|---|---|---|
| JP | 11-060132 | A | 3/1999 |
| JP | H11-292448 | A | 10/1999 |
| JP | 2006-027790 | A | 2/2006 |
| JP | 2010-64821 | A | 3/2010 |
| JP | 2010-168126 | A | 8/2010 |
| JP | 2016-132550 | A | 7/2016 |
| JP | 2016-160047 | A | 9/2016 |

* cited by examiner

*Primary Examiner* — Kavel Singh

(74) *Attorney, Agent, or Firm* — Foley & Lardner LLP

(57) ABSTRACT

A passenger conveyor has a guardrail belt configured to run on a pair of right and left handrails in synchronization with footsteps; a camera provided at a platform of the handrail; and a control device configured to analyze an image obtained by photographing the platform with the camera, detect a passenger getting in from the platform, stop the footsteps or lower a running speed than a normal speed when detecting no passenger for a predetermined time, and move the running speed of the footsteps at the normal speed when detecting the passenger.

6 Claims, 7 Drawing Sheets

PASSENGER CONVEYOR

CROSS-REFERENCE TO RELATED APPLICATIONS

This application is based upon and claims the benefit of priority from the prior Japanese Patent Application No. 2018-036177, filed on Mar. 1, 2018, the entire contents of which are incorporated herein by reference.

FIELD

Embodiments of the present invention relate to a passenger conveyor.

BACKGROUND

In related art, in a passenger conveyor such as an escalator and a moving walkway, a plurality of photoelectric sensors, proximity sensors, and limit switches are installed in order to check presence or absence of a passenger or ensure safety during an automatic operation.

However, it was necessary to install a plurality of sensors and switches in the escalator, and there were problems of increase in costs and complicated tasks of installing and wiring sensors and switches.

In view of the above problems, an object of the embodiment of the present invention is to provide a passenger conveyor in which the sensors and switches for securing the safety of a passenger are reduced as much as possible.

DETAILED DESCRIPTION

An embodiment of the present invention is directed to a passenger conveyor which includes a plurality of footsteps configured to move in a front-rear direction, a drive device configured to move the footsteps, a pair of right and left handrails erected on both right and left sides of the footsteps, a guardrail belt configured to run on the pair of right and left handrails in synchronization with the footsteps, a camera provided at a platform of the handrail, and a control device configured to analyze an image obtained by photographing the platform with the camera, detect a passenger getting in from the platform, stop the footsteps using the drive device or lower a running speed than a normal speed when detecting no passenger for a predetermined time, and move the running speed of the footsteps at the normal speed, using the drive device, when detecting the passenger.

Hereinafter, an escalator 10 according to the embodiment of the present invention will be described with reference to FIGS. 1 to 7.

(1) Escalator 10

Figure 1:
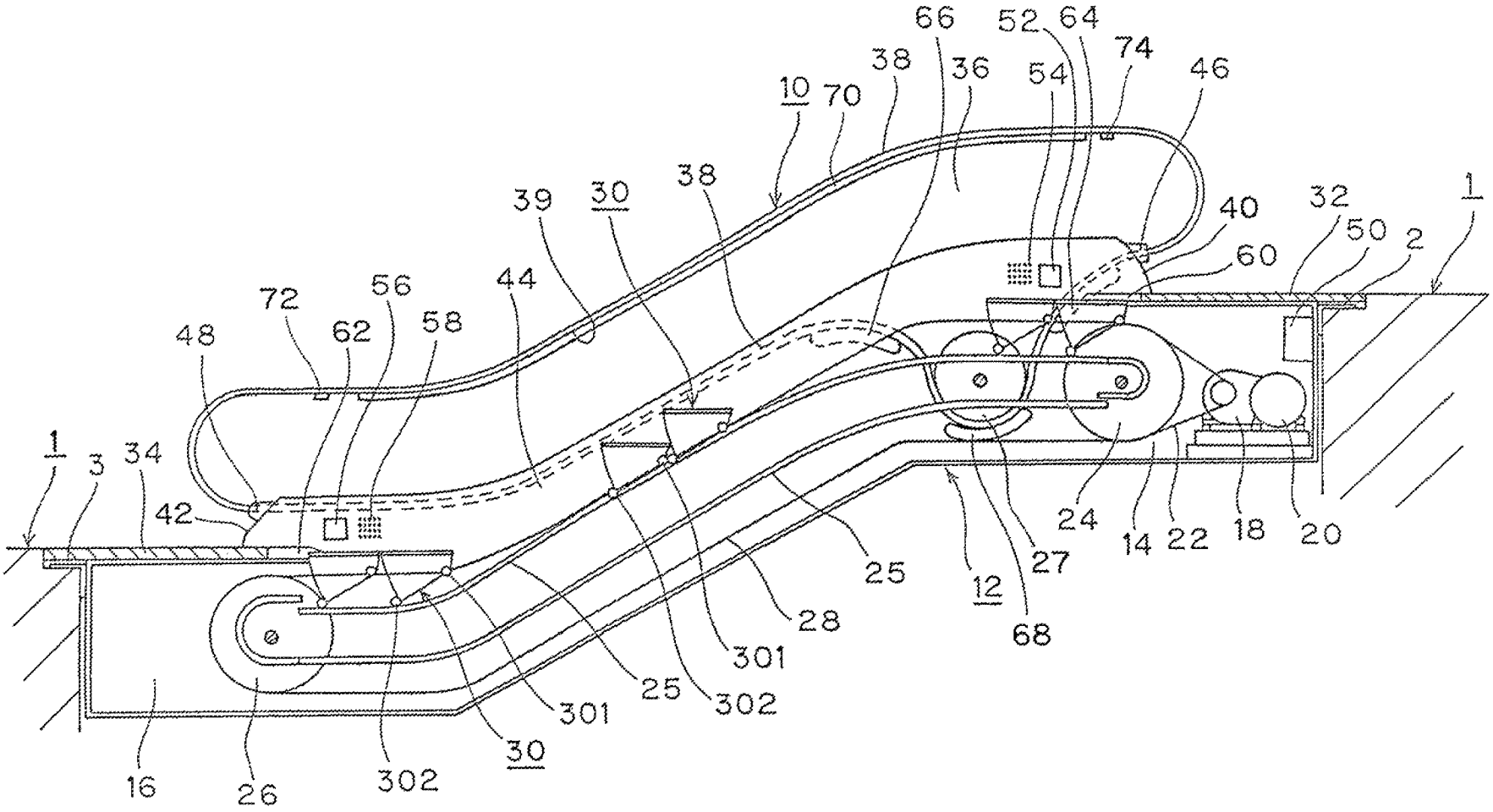
FIG. 1 is a side view of an escalator according to an embodiment of the present invention.

A structure of the escalator 10 will be described with reference to FIG. 1. As illustrated in FIG. 1, a truss 12 which is a framework of the escalator 10 is supported to straddle upper and lower floors of a building 1, using support angles 2 and 3.

As illustrated in FIG. 1, a drive device 18 which causes a footstep 30 to run, a pair of right and left drive sprockets 24 and 24, and a pair of right and left belt sprockets 27 and 27 are provided inside a machine room 14 on the upper floor side at an upper end portion of the truss 12. The drive device 18 has a motor 20, a speed reducer, an output sprocket attached to an output shaft of the speed reducer, a drive chain 22 driven by the output sprocket, and a disc brake that stops the rotation of the motor 20 and holds the stopped state. The drive sprocket 24 is rotated by the drive chain 22. The pair of right and left drive sprockets 24 and 24 and the pair of right and left belt sprockets 27 and 27 are connected by a connecting belt (not illustrated) to rotate synchronously. Further, a control device 50, which controls the motor 20, the disc brake, and the like, is provided inside the machine room 14 on the upper floor side.

As illustrated in FIG. 1, a driven sprocket 26 is provided inside the machine room 16 on the lower floor side at a lower end portion of the truss 12. A pair of right and left endless footstep chains 28 and 28 is stretched between the drive sprocket 24 on the upper floor side and the driven sprocket 26 on the lower floor side. As illustrated in FIG. 1, front wheels 301 of a plurality of footsteps 30 are attached to the pair of right and left footstep chains 28 and 28 at equal intervals. The front wheel 301 of the footstep 30 run along a front guide rail (not illustrated) fixed to the truss 12, and engages with a recess on an outer circumferential portion of the drive sprocket 24 and a recess on an outer circumferential portion of the driven sprocket 26 to turn upside down. Rear wheels 302 run on a rear guide rail 25 fixed to the truss 12 as illustrated in FIG. 1.

As illustrated in FIG. 1, a pair of right and left skirt guards 44 and 44 and a pair of right and left handrails 36 and 36 are erected on both the right and left sides of the truss 12. A guardrail rail 39 is provided above the handrail 36, and a guardrail belt 38 moves along the guardrail rail 39. A front skirt guard 40 on the upper floor side is provided on a front lower side of the upper floor side of the handrail 36, a front skirt guard 42 on the lower floor side is provided on the front lower side of the lower floor side, and inlet units 46 and 48 which are entrances of the guardrail belt 38 protrude from the front skirt guards 40 and 42, respectively. The skirt guard 44 is provided at the side surface lower side of the handrail 36, and the footstep 30 runs between the pair of right and left skirt guards 44 and 44. An upper operation panel 52, a lower operation panel 56, an upper speaker 54, and a lower speaker 58 are provided on the inner surface of the skirt guard 44 on the upper and lower floors, respectively. Further, a pair of right and left lighting devices 70 and 70 for lighting the handrail 36 is provided on the guardrail rails 39 and 39 in the inclined portions of the pair of right and left handrails 36 and 36.

As illustrated in FIG. 1, the guardrail belt 38 enters the front skirt guard 40 from the inlet unit 46 on the upper floor side, is stretched around the belt sprocket 27 via a guide roller group 64, and then, moves in the skirt guard 44 via a guide roller group 66 to exit from the inlet unit 48 on the lower floor side to the outside of the front skirt guard 42. Further, the guardrail belt 38 moves in synchronization with the footstep 30 as the belt sprocket 27 rotates together with the drive sprocket 24. Further, a pressing member 68 for pressing the guardrail belt 38 running on the rotating belt sprocket 27 is provided.

As illustrated in FIG. 1, a platform board 32 on the upper floor side is horizontally provided at a platform on a ceiling surface of the machine room 14 on the upper floor side, and a platform board 34 on the lower floor side is provided horizontally at a platform on the ceiling surface of the machine room 16 on the lower floor side. A comb-like comb 60 is provided at a distal end of the platform board 32, and the footstep 30 enters or exits from the comb 60. Further, a comb-like comb 62 is also provided on the platform board 34.

(2) Image Analysis System

In the escalator 10 of the present embodiment, a system which performs the safety securing and detection of the passenger by an image analysis is provided, instead of the photoelectric sensor, the proximity sensor, and the limit switch of the safety device for performing the safety securing and detection of the passenger which are conventionally provided. The image analysis system will be described with reference to FIGS. 2 to 4. Further, the escalator 10 of the present embodiment is not provided with a sensor for detecting the passenger, and a switch for detecting whether a pair of right and left inlet units 46, 46, 48 and 48 on the upper and lower floors is pressed, which are conventionally provided. Further, in the present embodiment, as illustrated in FIG. 3, right and left are defined as a right (R) and a left (L) in a state in which the lower floor is viewed from the upper floor.

Figure 4:
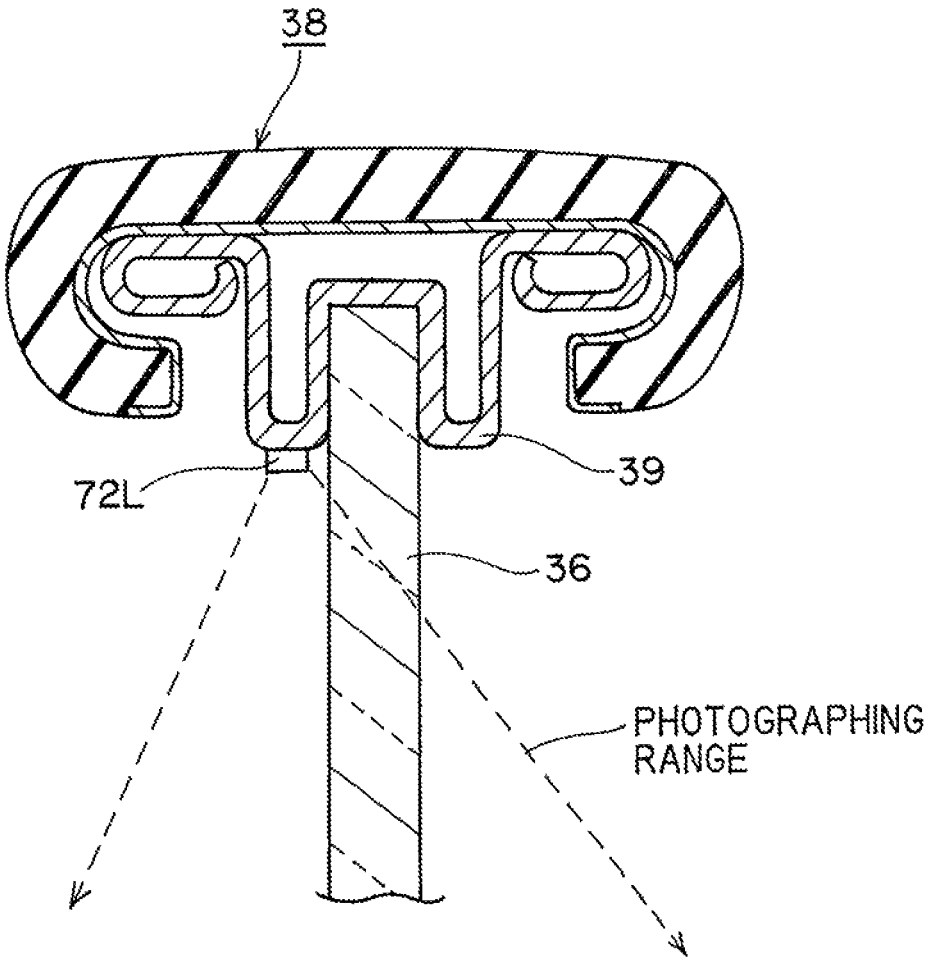
FIG. 4 is a vertical sectional view of a guardrail belt on a left side and a guardrail rail.

First, as illustrated in FIG. 4, the pair of right and left handrails 36 and 36 is formed of a glass plate, and guardrail rails 39 and 39 are provided at the upper end portions thereof. The guardrail belt 38 having a C-shaped cross section runs on the guardrail rail 39.

Figure 2:
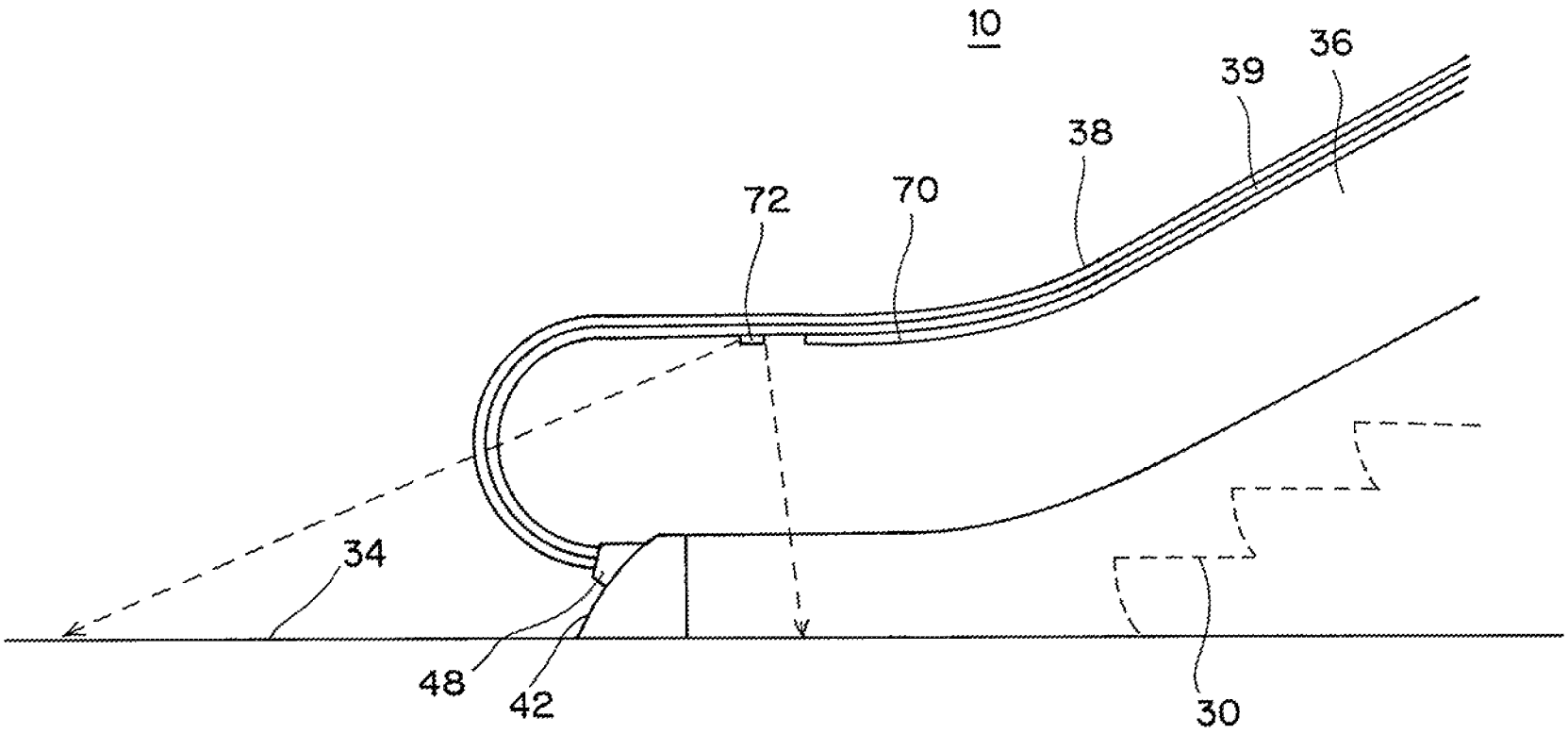
FIG. 2 is a side view of a platform of the escalator on a lower floor.
Figure 3:
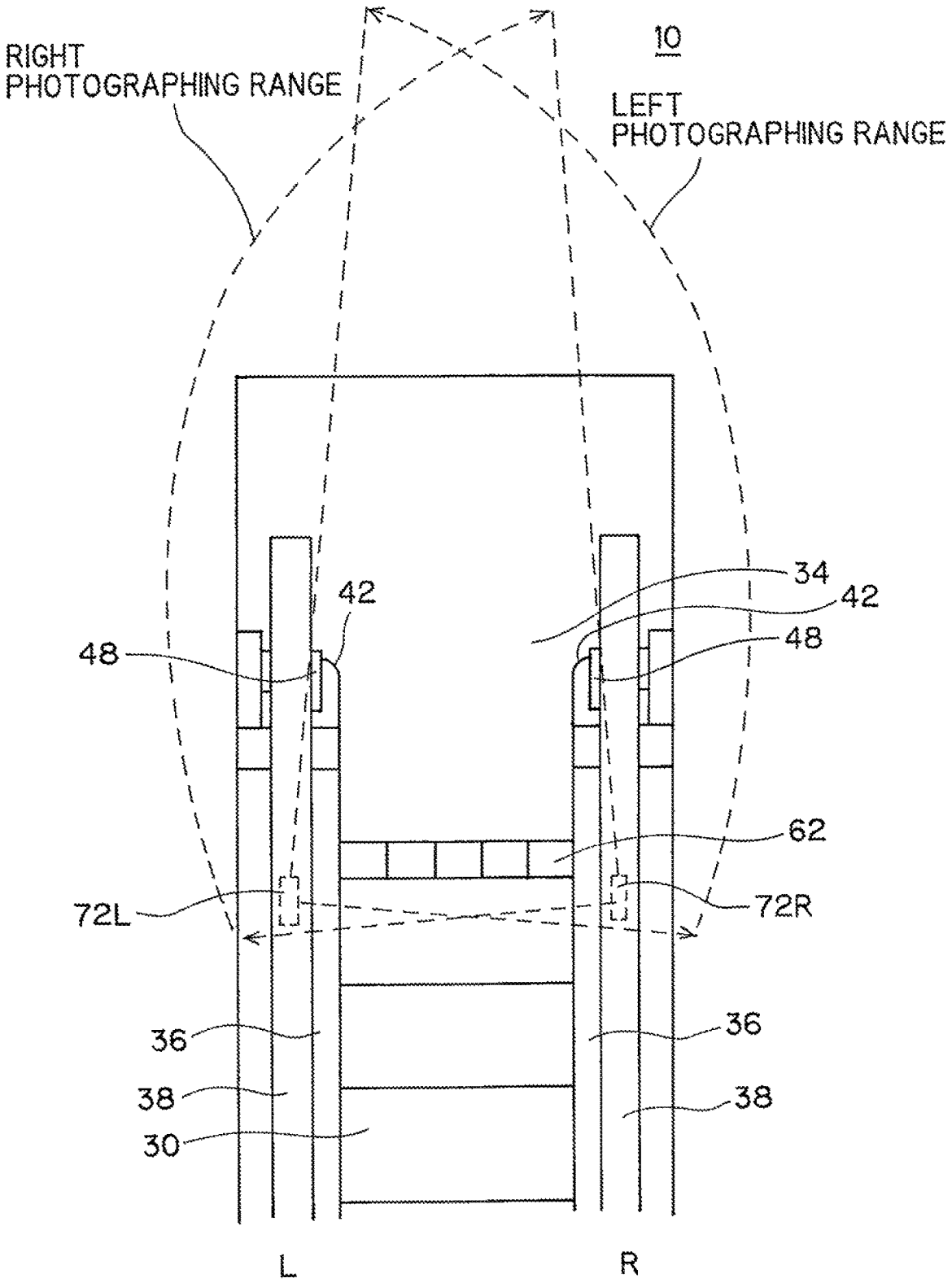
FIG. 3 is a plan view of the escalator on the lower floor.

A left camera 72L of the lower floor is provided on the handrail 36 of the lower floor as illustrated in FIGS. 1 and 2, and is provided at a position on the outside of the lower part of the guardrail rail 39 above the left handrail 36 on the lower floor, that is, on a side opposite to the footstep 30 side as illustrated in FIGS. 3 and 4. In FIG. 3, a photographing range in a plan view of the left camera 72L is indicated by a dotted line of an arrow.

A right camera 72R of the lower floor is provided on the handrail 36 of the lower floor as illustrated in FIGS. 1 and 2, and is provided on the outer side of the lower part of the guardrail rail 39 of the right handrail 36 on the lower floor as illustrated in FIG. 3. Further, in the plan view of FIG. 3, the photographing range in the plan view of the right camera 72R is indicated by a dotted line of an arrow.

Figure 5:
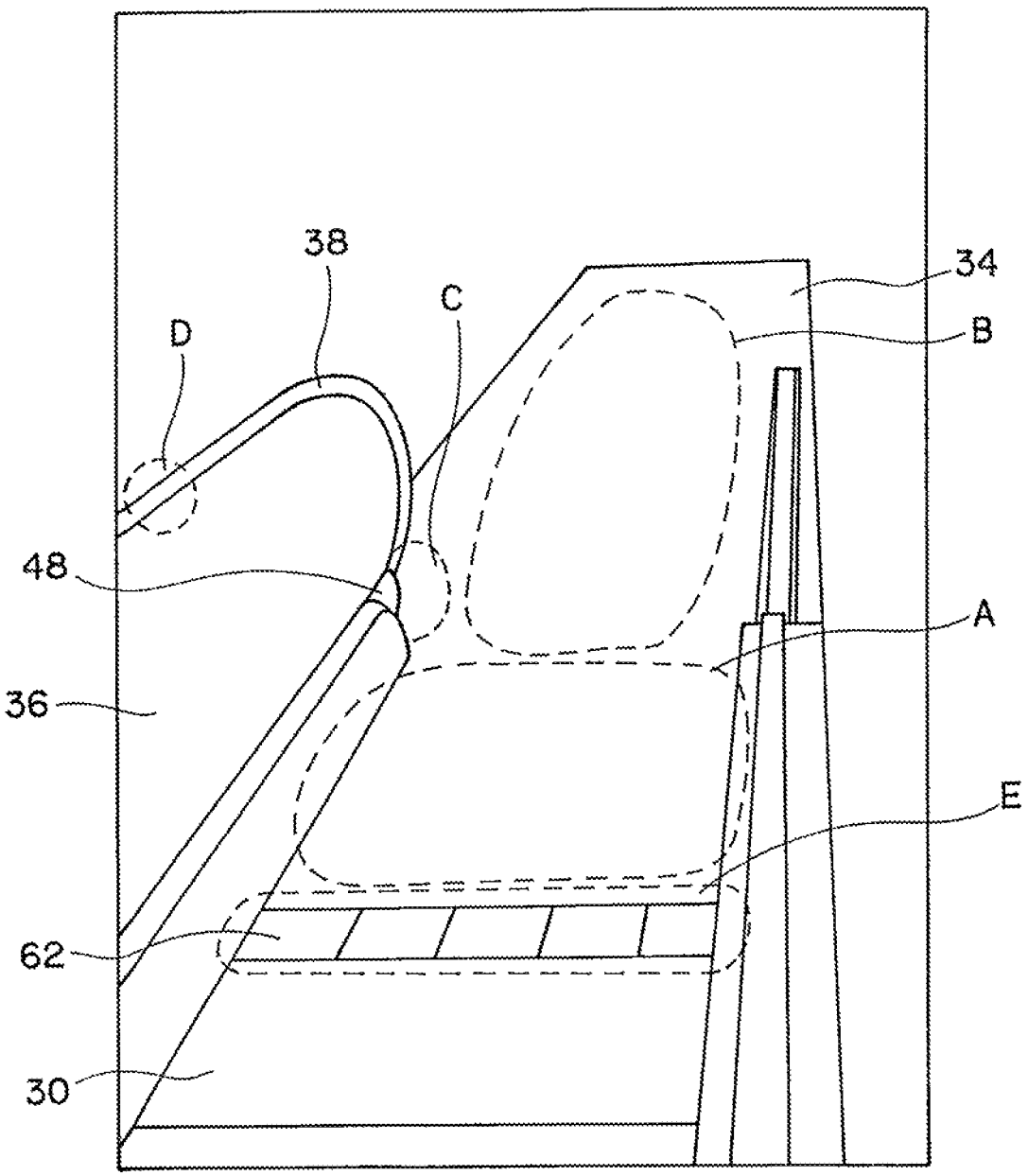
FIG. 5 is a diagram of a right image photographed with a right camera.
Figure 6:
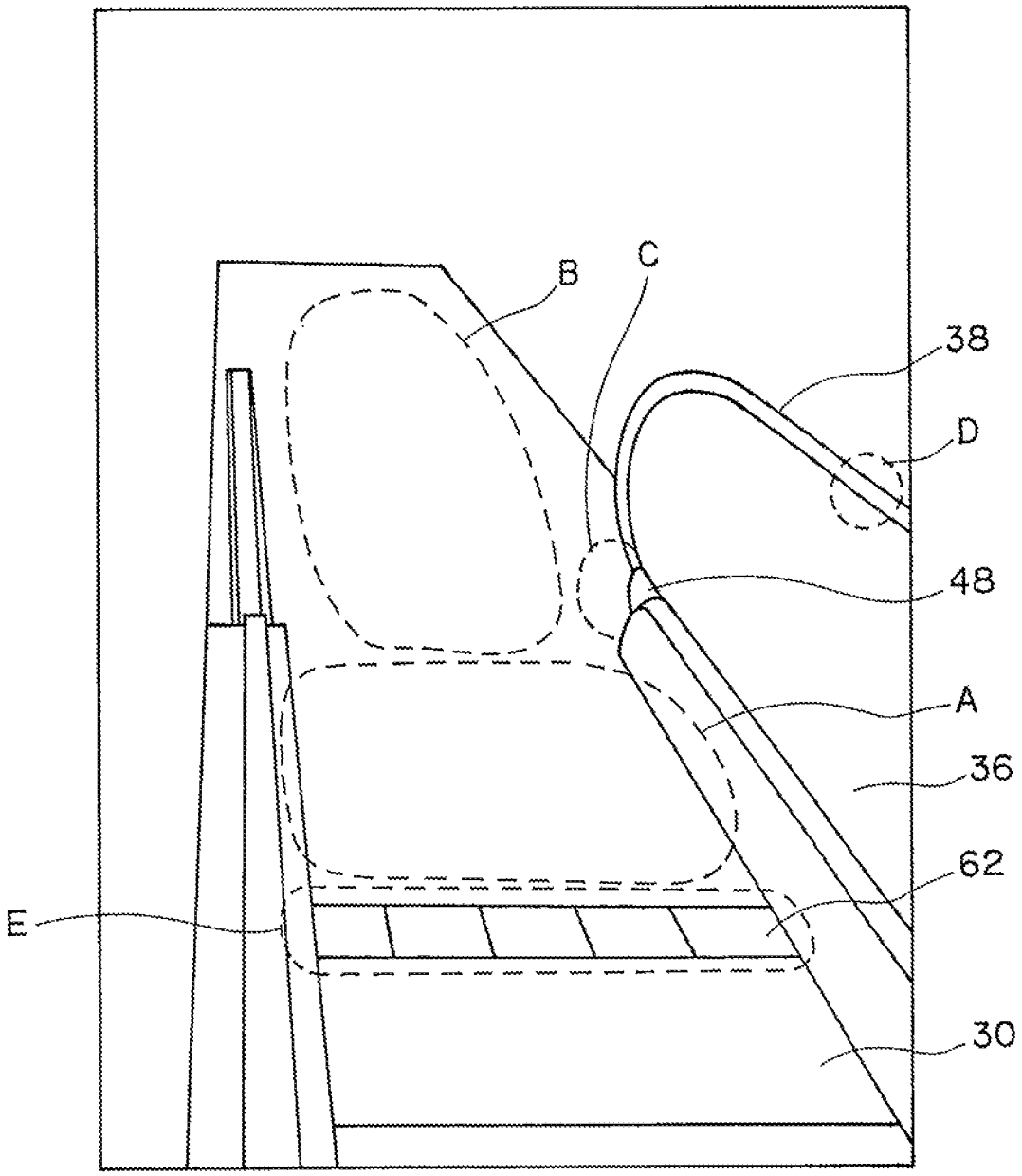
FIG. 6 is a diagram of a left image photographed with a left camera.

As illustrated in FIG. 2, the pair of right and left cameras 72R and 72L is provided downward, and is set to photograph the bottom of the handrail 36 as in a dotted line indicated by an arrow. In FIGS. 1 and 2, a pair of right and left cameras 72L and 72R is collectively indicated by "72". FIG. 5 illustrates one frame (hereinafter referred to as a "right image") of the moving image photographed by the right camera 72R, and illustrates the footstep 30 located below the right camera 72R, the left skirt guard 44, the left handrail 36, the left inlet unit 48, and the platform board 34 of the lower floor are captured therein. FIG. 6 illustrates one frame (hereinafter referred to as a "left image") in the moving image photographed by the left camera 72L.

Further, as illustrated in FIG. 1, the handrail 36 at the platform of the upper floor also has a left camera 74L and a right camera 74R. In FIG. 1, a pair of right and left cameras 74R and 74L is collectively indicated by "74".

(3) Electrical Configuration of Escalator 10

Figure 7:
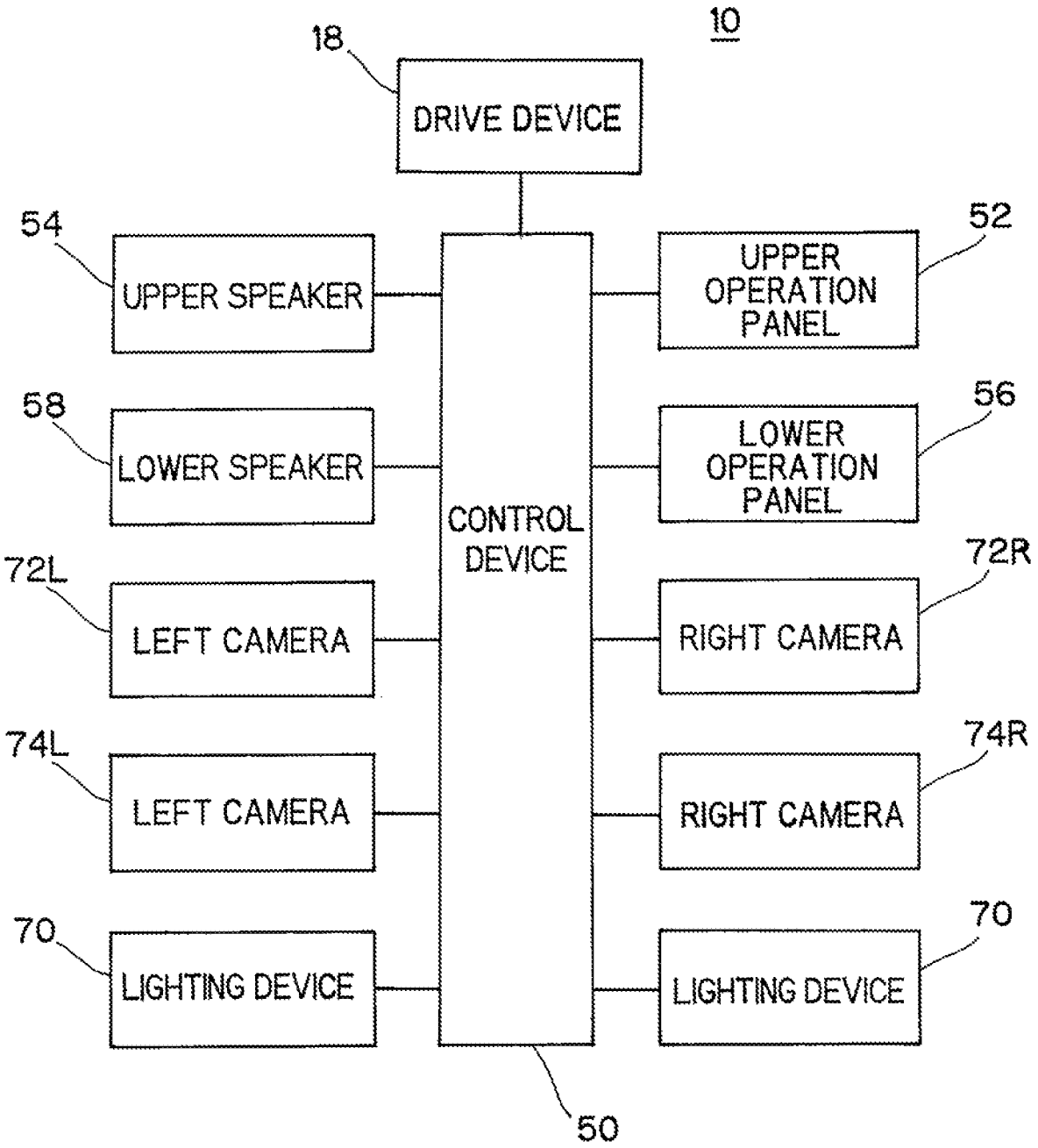
FIG. 7 is a block diagram of the escalator.

Next, the electrical configuration of the escalator 10 will be described with reference to the block diagram of FIG. 7.

The drive device 18, the upper operation panel 52, the lower operation panel 56, the lighting devices 70 and 70, the upper speaker 54, and the lower speaker 58 are connected to the control device 50, and the left camera 72L and the right camera 72R of the lower floor, and the left camera 74L and the right camera 74R of the upper floor are connected to the control device 50.

(4) Method of Image Analysis

Next, a method of analyzing the images photographed by the left camera 72L and the right camera 72R on the lower floor using the control device 50 will be described. In the following description, the right image photographed by the right camera 72R on the lower floor will be described with reference to FIG. 5. FIG. 5 illustrates the right image photographed by the right camera 72R on the lower floor, and FIG. 6 illustrates the left image photographed by the left camera 72L on the lower floor.

As illustrated in FIG. 5, the control device 50 sets five image areas from an area A to an area E on the right image. Each of the image areas A to E is determined by vertical and horizontal pixel positions constituting the right image. Hereinafter, the image analysis method for each area will be described in order.

Regarding the area A of FIG. 5, the control device 50 detects whether the passenger is present on the platform board 34 between the pair of right and left handrails 36 and 36 on the lower floor. In the detecting method, the control device 50 stores a right background image in which no passenger is present in advance, compares the area A of the right background image with the area A of the right image to be input, and determines that there is a passenger if there is a change area. Further, instead of storing the right background image, the control device 50 may compare the past right image one before the current right image with the current right image, and may determine that there is a passenger if there is a change area.

Regarding the area B of FIG. 5, the control device 50 detects whether the passenger is present on the platform board 34 outside the pair of right and left handrails 36 and 36 on the lower floor. This detecting method is similar to that of the area A.

Regarding the area C of FIG. 5, the control device 50 detects whether an object exists near the left inlet unit 48 of the lower floor. This detecting method is similar to that of the area A.

Regarding the area D of FIG. 5, the control device 50 detects the hand of the passenger on the guardrail belt 38 near the platform of the lower floor. The reason for detecting the hand at this position is to check whether the passenger grips the guardrail belt 38 from the platform. This detecting method is the same as the area A. As another method, since the human hand usually has higher luminance than the guardrail belt 38, if an area with a higher luminance value than the other area is in a part of the area D, the control device 50 may determine that the hand is detected.

Regarding the area E of FIG. 5, the control device 50 detects whether the comb 62 of the lower floor is normal or broken. This detecting method is performed in the same manner as the area A, and if there is a change area in the comb 62, it is determined that the part is broken.

(5) Control Method

Next, a control method of the control device 50 will be described in order. In this explanation, it is assumed that the footstep 30 of the escalator 10 is ascending, the lower floor is an entrance, and the upper floor is an exit.

When a passenger is present in the escalator 10, the control device 50 controls the drive device 18 so that the footstep 30 runs at a normal speed.

If the passenger is not detected for a certain period of time (for example, five minutes or more) in the area A of the lower floor, the control device 50 stops running of the footstep 30 or makes the running speed of the footstep 30 slower than the normal speed. Further, if the passenger is not detected for a period of time (for example, one hour or more) longer than a predetermined time, the control device 50 turns off the lighting devices 70 and 70. Further, when a passenger is detected in the area A of the lower floor, the control device 50 causes the footstep 30 to run at the normal speed and turns on the lighting devices 70 and 70. Regarding the area A, since the control device 50 can photograph both the right image and the left image, the control device 50 performs detection only from one among the images.

When detecting the passenger in the areas A and B, the control device 50 determines that a plurality of passengers is staying. Therefore, the control device 50 performs an announcement "please do not stop at platform" by voice, using the upper speaker 54 and the lower speaker 58. However, when a staying state of the passenger in the area B continues for a certain period of time (for example, 10 minutes or more), it is considered that there is no announcement effect, and the announcement is stopped. Regarding the areas A and B, since the control device 50 can photograph both the right image and the left image, the control device 50 performs detection only from one among the images. Further, the staying refers to a state in which a plurality of passengers is stopped or hardly moves (for example, a state at or below a preset walking speed).

When an object is detected in the area C of the left image, the control device 50 determines that a baggage or a hand is approaching the right inlet unit 48, announces so as not to approach, or gives a warning with a buzzer sound. Further, when detecting the object in the area C of the right image, the control device 50 determines that the baggage or the hand is approaching the left inlet unit 48, announces so as not to approach, or gives a warning with a buzzer sound.

When the hand can be detected in the area D, the control device 50 determines that it is normal, detects the passenger in the area A, and when the hand cannot be detected in the area D, the control device 50 performs an announcement "please hold your guardrail belt". The control device 50 can monitor the left guardrail belt 38 in the right image as illustrated in FIG. 5, and the control device 50 can monitor the right guardrail belt 38 in the left image as illustrated in FIG. 6. In this case, this announcement is performed only when the hand cannot be detected in both the right and left images.

In the area E, when it is detected that the comb 62 of the lower floor is broken, the control device 50 outputs a notification signal that the comb 62 of the lower floor is broken to an external management device. Further, the footstep 30 of the escalator 10 may be stopped. Regarding the area E, since the control device 50 can photograph both the right image and the left image, the control device 50 detects only from one among the images.

Regarding the right and left images photographed by the pair of right and left cameras 74R and 74L of the upper floor on the exit side, the detection of the presence or absence of a passenger in the area A, the staying state of the areas A and B, and whether the passenger is gripping the guardrail belt 38 of the area D by hand may not be performed, and only the detection of whether the object is approaching the inlet unit 46 of the area C or whether the comb 60 on the upper floor of the area E is normal or broken may be performed.

(6) Effect

With the escalator 10 according to the present embodiment, since the presence or absence of a passenger, the staying state of a passenger, a hand or a baggage approaching the inlet units 46 and 48, whether the passenger grips the guardrail belt 38 by hand, and whether the combs 60 and 62 are broken can be detected by the image analysis, sensors and switches are unnecessary, and the number of sensors and switches can be reduced as compared with the related part. Therefore, the cost can be reduced, and the installation work of the escalator 10 can be simplified.

Although the escalator 10 has been described in the above embodiment, it may be applied to a moving walkway instead.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A passenger conveyor comprising:

a plurality of footsteps configured to move in a front-rear direction;

a drive device configured to move the footsteps;

a pair of right and left handrails erected on both right and left sides of the footsteps;

a guardrail rail provided above each of the pair of right and left handrails;

a guardrail belt configured to run on the guardrail rail above the pair of right and left handrails in synchronization with the footsteps, a right inlet unit and a left inlet unit from which the guardrail belt enters a front skirt guard by moving from an upper part to a lower part of the right and left handrails, respectively;

a camera provided downward at a bottom of each of the pair of right and left guardrail rails; and a control device configured to:

acquire a left image obtained by photographing the inlet unit on a right side with the camera on a left side, acquire a right image obtained by photographing the inlet unit on a left side with the camera on a right side, analyze both the right and left images, detect whether an object is present in the vicinity of at least one of the right inlet unit or left inlet unit, and give a warning when an object has been detected.

2. The passenger conveyor according to claim 1, further comprising:

a lighting device configured to light the pair of right and left handrails, wherein the control device turns off the lighting device when detecting no passenger for the predetermined time, and turns on the lighting device when detecting the passenger.

3. The passenger conveyor according to claim 1, wherein the control device gives a warning when analyzing the image to detect a plurality of passengers at the platform.

4. The passenger conveyor according to claim 1, further comprising:

a platform board disposed between the pair of right and left handrails at the platform; and a comb which is provided at a distal end of the platform board and through which the footsteps enter or exit, wherein the control device analyzes the image to determine whether the comb is broken, and gives a warning when the comb is broken.

5. The passenger conveyor according to claim 3, further comprising:

a speaker configured to output voice, wherein the control device performs the warning by voice, using the speaker.

6. The passenger conveyor according to claim 1, wherein the control device is configured to analyze both the left image and the right image, detect a passenger getting on the platform, stop the footsteps using the drive device or lower a running speed than a normal speed when detecting no passenger for a predetermined time, and move the running speed of the footsteps at the normal speed, using the drive device, when detecting the passenger.

* * * * *